United States Patent [19]

Taylor

[11] Patent Number: 4,977,722

[45] Date of Patent: Dec. 18, 1990

[54] FRAME SYSTEM

[75] Inventor: Donald M. Taylor, Orangeville, Canada

[73] Assignee: Repla Limited, Ontario, Canada

[21] Appl. No.: 366,077

[22] Filed: Jun. 14, 1989

[51] Int. Cl.[5] ..... E04B 9/17

[52] U.S. Cl. ..... 52/731; 52/656

[58] Field of Search ..... 52/731, 656, 788, 729, 52/730, 732; 49/DIG. 1, DIG. 2

[56] References Cited

U.S. PATENT DOCUMENTS 3,269,074 8/1966 Darmstadt ..... 52/731 X 4,640,078 2/1987 Haffer ..... 52/731

*Primary Examiner*—Richard E. Chilcot, Jr.

*Attorney, Agent, or Firm*—Caesar, Rivise, Bernstein, Cohen & Pokotilow, Ltd.

[57] ABSTRACT

A peripheral frame is provided suitable for use as the frame or sash for a glazed window or patio door unit, or for use as an outer frame or semi-peripheral frame to contain window or door units. The frame is of U-form section, having a pair of substantially parallel legs and an interconnecting end portion forming an outwardly facing bight. The outer surface of the section end portion forms the inner periphery of the frame and the leg portions of the section form the faces of the frame, and, provide an outer peripheral access to the interior of the frame section. The frame can be provided with various concealed inserts appropriate to its function located in the interior of the section, such as wood, metal or other inserts. Such inserts may comprise reinforcement frames and insulation material, including foamed in-situ insulation and reinforcement; and attachment and/or suspension hardware for components supported by the frame. The frame inner periphery can be shaped to include one or more peripherally extending door jambs or glazing stops, and may include provision to secure snap-in glazing stop so as to facilitate installation of glazing units, either insulated (eg. gas filled) or plain. Peripheral frame cover plate portions can be removably or permanently secured in enclosing relation with the frame section.

37 Claims, 5 Drawing Sheets

FRAME SYSTEM

FIELD OF THE INVENTION

This invention is directed to a frame system for a peripheral frame, for attachment as a door or window opening to a structure, to contain a closure unit, or as a frame for a movable closure unit, such as a window sash or patio door.

BACKGROUND TO THE INVENTION

In the field of closures, including doors, window sashes, patio doors and the like, many developments have taken place in regards to items such as the doors, the glazing units, hardware and the like, while the associated frame units have remained substantially unchanged. This has presented both thermal and structural problems, as well as aesthetic problems.

In light of the present invention it is now apparent that many of these problems may have stemmed from the continued use of pre-existing types of closure frame structures, in regards both to their use as movable closure frames, and as the peripheral or semi-peripheral support frames therefor.

SUMMARY OF THE INVENTION

The present invention provides a peripheral or semi-peripheral frame having a U-section construction, with the outer surface of the U-section end portion, intermediate the legs of the U, forming the inner periphery of the frame or semi-frame. The bight or open end portion of the U-section faces outwardly of the frame.

The above described U-section may be extruded, or fabricated by welding or forming and the frame corners may be welded or mechanically secured.

The frame inner surface, comprising the outer surface of the U-section end portion, may include one or more inwardly protruding, peripherally extending ribs, for use as glazing stops, to facilitate the installation of glazing units within the frame. Provision can be made in the shape of the section, to receive snap-in peripheral ribs complementary to the formed ribs of the section, for securing the glazing unit therebetween.

The exteriorly accessible U-section of the frame, or semi-frame in the case of a door frame comprising two jambs and a lintel, permits the location of a multiplicity of ancilliary frame components, or associated members, or hardware in concealed or partially concealed relation within the frame section. Such components include interior reinforcing frames or frame inserts of wood, metal and plastic, including foamed in-situ thermal and sound insulation. Also, the outward facing U-section lends itself to the provision or addition of peripheral fitting strips to facilitate attachment of the frame to adjacent structures. Such fitting strips ma be of readily abradable material such as wood, suitable for being dressed to fit, in-situ, into structure openings.

Further, cover plates can be readily provided to fit the outer perimeter of the frame, so as to enclose part or all of the interior of the U-section.

The associated hardware, which is locatable within the U-section of the frame in the case of sliding doors such as patio doors, can include suspension means, such as rollers and the like, as well as attachment means including locks and hinges.

It can thus be seen that the adoption of an outward facing U-section as a peripheral frame or semi-frame affords a number of unobvious yet significant benefits, while resulting in an aesthetically pleasing, economically practical structure of unusual utility.

The present invention further includes in a framing system the method comprising the steps of providing a plurality of U-section members of predetermined length, joining the members in corner abutting relation to form a frame of predetermined shape and size, having the closing end portion of the U-section forming the inner periphery of the frame, with the side members of the U-section constituting face portions of the frame and affording access therebetween to the open interior of the frame section; and facilitating location of additional components of the system in secured relation within the section hollow interior.

The step of locating additional components in the hollow section may include; the insertion and connection of interior frame-reinforcement members: the foaming in-situ of insulation and/or reinforcement within the section; the location and attachment of hardware therein such as suspension means and attachment means; the attachment of fitting strips and/or nailing strips for receiving nail-on dressing strips; and the attachment of section closure plates in removable o permanent closing relation with portions of or the whole of the frame periphery.

BRIEF DESCRIPTION OF THE DRAWINGS

Certain embodiments of the invention and the system for its construction are described as follows, by way of example and without limitations of the invention thereto, reference being made to the accompanying drawings, wherein.

DETAILED DESCRIPTION OF THE INVENTION

Figure 1:
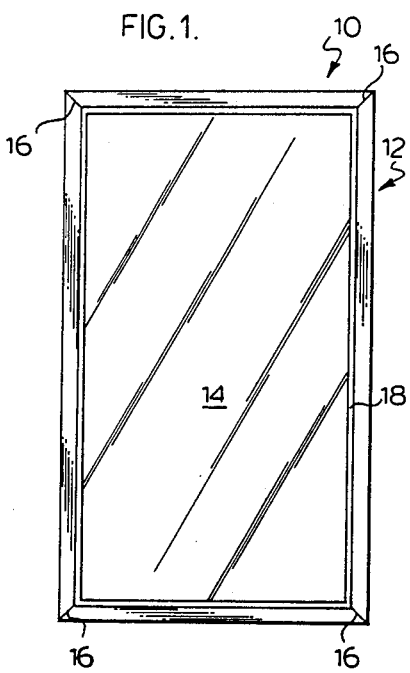
FIG. 1 is a elevational view of a patio door having the frame thereof constructed in accordance with the present invention.

Referring to FIG. 1 a glazed patio door 10 has a frame 12 in accordance with the present invention, and a glazing unit 14 secured therein.

The frame 12 is illustrated a having welded bevel corners 16 and an integral glazing stop 18, described in more detail below.

Figure 2:
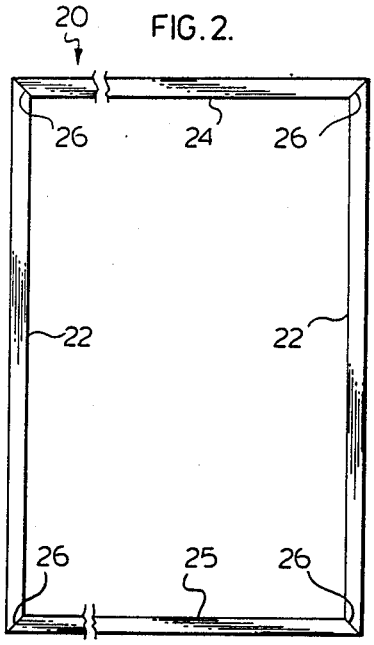
FIG. 2 is a like view of a patio door exterior frame constructed in accordance therewith.

Referring to FIG. 2, the patio door exterior frame 20 has side portions 22 and a lintel portion 24 and threshold portion 25 (both shown shortened).

The bevelled corners 26 also are illustrated as being of welded construction.

Figure 3:
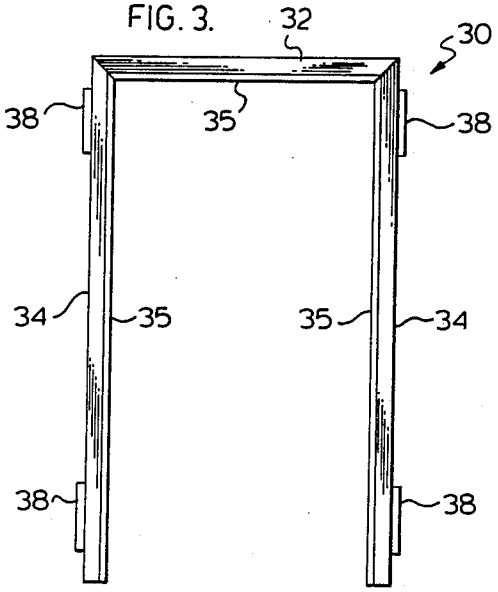
FIG. 3 is an elevational view of a three sided doorway constructed in accordance with the invention.

The open frame 30 of FIG. 3 has a lintel 32, and sides 34. The frame 30 incorporates integral jamb portions 35. Also shown are forms of dressable fitting strips 38 by means of which the frame 30 can be readily fitted to an appropriately sized opening by dressing the strips 38 to size, insitu.

Figure 4:
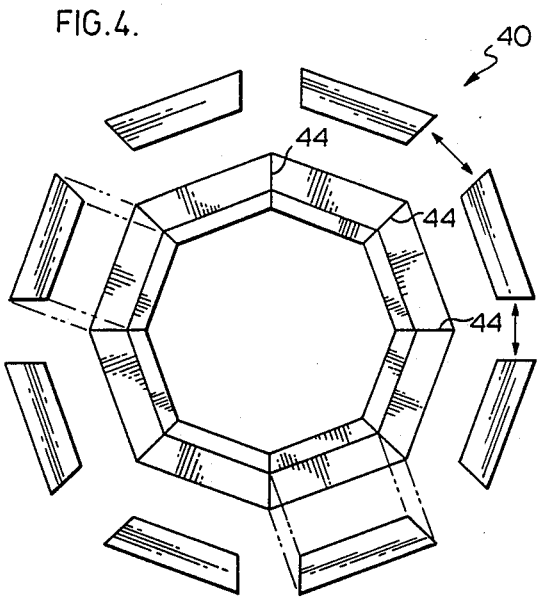
FIG. 4 is an elevational view of a closed octagonal frame having insert reinforcements in exploded relation adjacent thereto.

Referring to FIG. 4, the octagonal frame 40 has frame segments 42 having bevelled corner joints 44. Also illustrated are eight reinforcement segments 46 for introduction in concealed relation within the interior of frame 40. While illustrated as being separate segments 46, these segments may be prejoined such as by welding, glueing and the like into two half frames prior to insertion within the frame 40, in reinforcing relation therewith.

It will be understood that the respective frames 10, 20, 30 and 40 each comprises an embodiment of the U-form section of the present invention, to provide inward peripheral access to the interior of the respective frame section.

Figure 5:
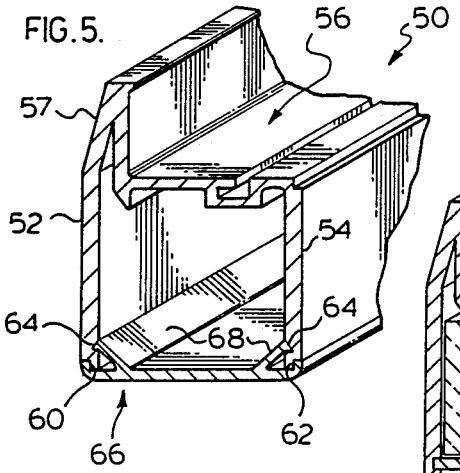
FIGS. 5 to 8 ar perspective cross-sectional views of four forms of the presently disclosed U-section, illustrating respective interior and exterior arrangements thereof.

Referring to FIGS. 5 through 8, in FIG. 5 the substantially U-shaped section 50 has opposed side portions 52,54 and intermediate end portion 56 in joining relation therebetween to form the U-section. In the illustrated embodiments the end portion 56 includes a projecting rib portion 57 that serves as a glazing stop and a re-entrant recess portion 58 to receive an insertable glazing stop in secured relation therein. The sides 52,54 of section 50 have relieved end portions 60,62 and axially extending triangular recesses 64 for attachment of cover 66 in snap-in secured relation therewith. The cover 66 has leg portions 68, the edges thereof engaging the respective recesses 64 in snap-in engagement therewith.

Figure 6:
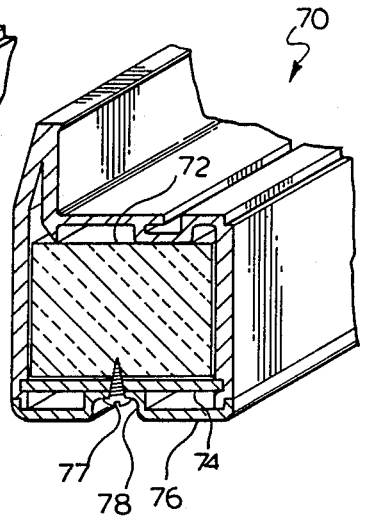

Referring to the FIG. 6 section embodiment 70 a simple rectangular insert 72 of foamed plastic is provided within an interior cover 74. A cover plate 76 is secured in place by way of screws 77, set into recesses 78.

Figure 7:
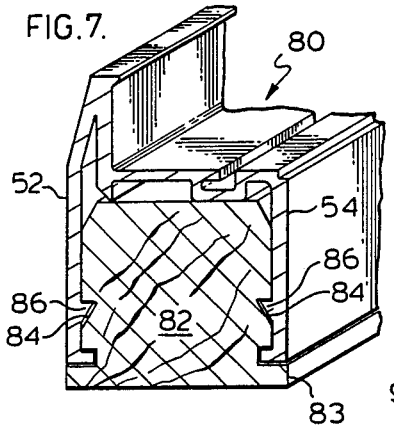

In the FIG. 7 embodiment the section 80 incorporates a shaped wood core 82, shown having recesses 84 wherein rib portions 86 of the section sides 52,54 are received. The core 82 includes external dressing strip portion 83, by which the frame, of which section 80 forms a part, may be sized insitu, to fit snugly within a structure opening. A frame incorporating this type of section 80 may be used as part of a hinged "leaf" door.

Figure 8:
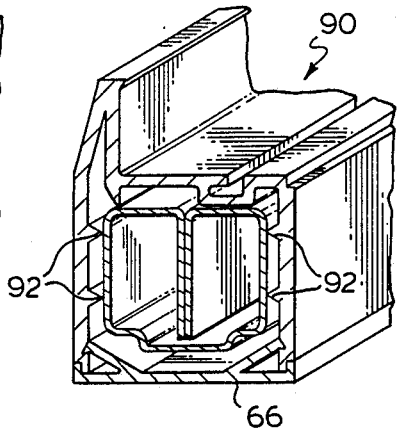
Figure 9:
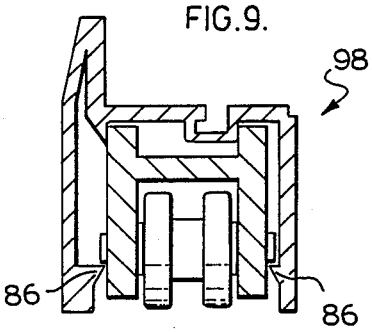
FIG. 9 is a like cross-sectional view illustrating the mounting of door support rollers.
Figure 10:
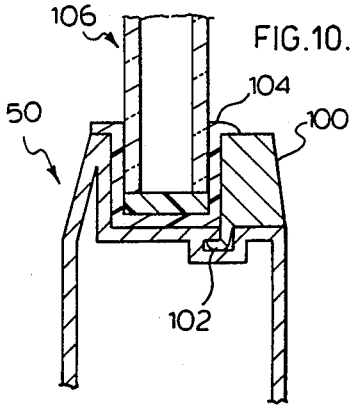
FIG. 10 is a cross-sectional view illustrating a portion of a patio door with glazing unit and glazing stop inserts.
Figure 11:
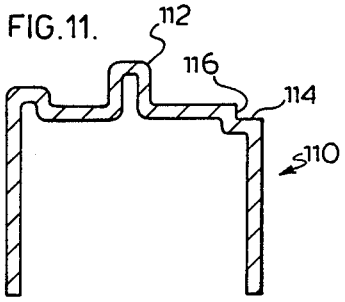
FIG. 11 is a cross-sectional view illustrating a sill portion of a patio door frame embodiment.
Figure 12:
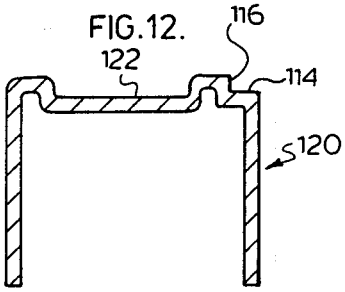
FIG. 12 is a cross sectional view of the side and top frame portions of the patio door frame embodiment.

Referring to FIG. 8, the section 90 includes rib portions 92 by which hollow core 94 is located within section 90. The core 94 may comprise a roll formed steel reinforcement body. The location of core 94 by way of rib portions 92 minimizes the thermal conductive path between section 90 exterior and interior portions.

A cover 66 is also illustrated, with glazing stop recess 102. A plastic glazing liner 104 received a dual glazed thermopane unit 106 in sealed, insulated relation. The permanent glazing stop 18 and insertable stop 100 hold the liner 104 and glazing unit 106 in secured, sealed relation.

Figure 13:
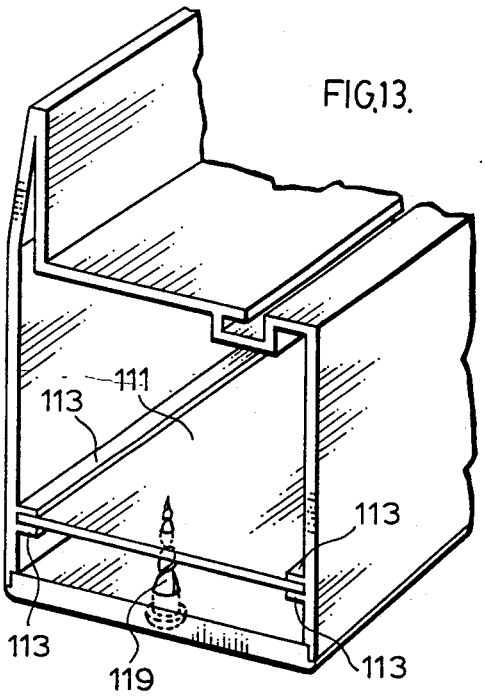
FIG. 13 is a perspective cross sectional view of a like embodiment to that of FIG. 7.

In the case of the FIG. 13 embodiment, a web reinforcement plate 111 is provided, in inserted relation within interior rib portions 113 that form grooves within the section 115. A cover plate 117 is secured by way of self-tapping fasteners 119, or other appropriate fasteners to the reinforcement plate 111. It will be understood that the interior space, above reinforcement plate 111 may contain a suitable filler piece, or reinforcement, or insulating material.

Figure 14:
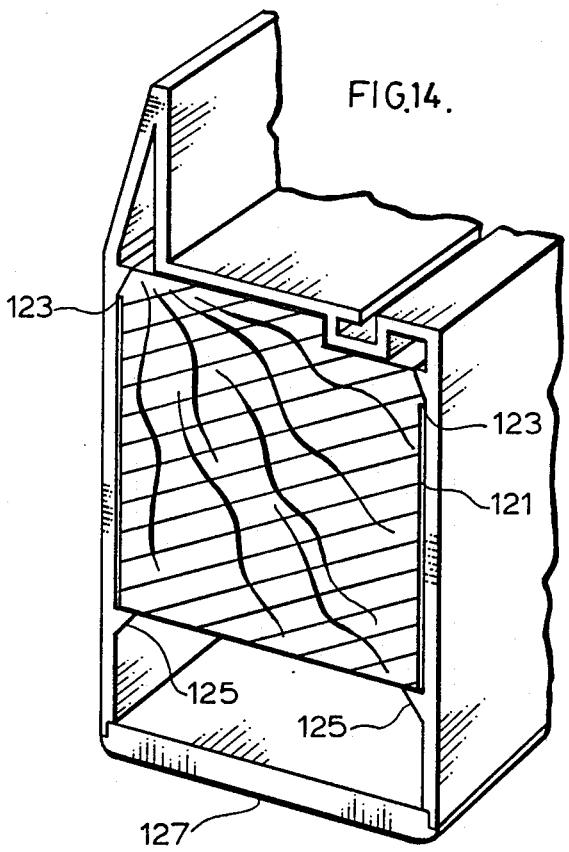
FIG. 14 is a perspective cross sectional view of a like embodiments to that of FIG. 8; and, FIG. 15 is a cross sectional view of a portion of frame in assembled relation with a portion of a double-pane unit.

In the FIG. 14 embodiment a filler piece 121 is positioned by wa of protruberant rib portions 123 and retained by interior section rib portions 125. The section cover plate 127 may be secured to the filler piece 121 by way of suitable fasteners (not shown), as in FIG. 13.

Figure 15:
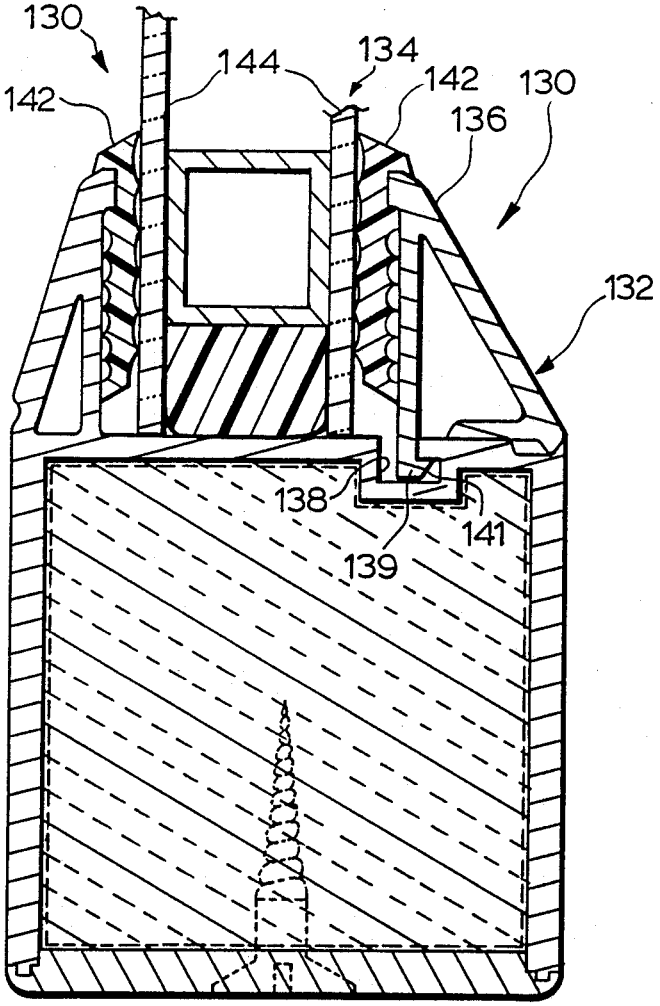

In FIG. 15 a yet further section variant 130 is shown, wherein a clip-in glazing stop assembly 132 secures a dual-pane glazing unit 134 in place. The intermediate spacer/seal means of glazing unit 134, located between the panes, is represented diagramatically only.

The insertable stop assembly 132 has a rigid angle section 136 for downward insertion in engaging relation within the re-entrant recess 138. Leg portion 139 includes an inclined edge portion 141 that serves as a cam, to facilitate assembly. A horizontal surface portion of leg 139 serves as a catch to anchor assembly 132.

An elastomeric seal 142 on each side of the glazing unit 134 provides sufficient compressibility between section 136 and the adjacent pane 144 to enable downward passage of leg portion 139. With the step assembly 132 in position, retrieval thereof by dissassembly is not generally contemplated, although it may be feasible.

The provision of insertable stop assemblies 132 on one side of a glazing unit greatly facilitates initial assembly of a glazing unit to its frame. Subsequent replacement of a broken glazing unit also is equally facilitated by the provision of the stop assemblies 132, which generally will weatherseal the periphery of the glazing unit to its frame.

A reinforcement filler is bonded or injected within the hollow portion of section 130, to which the cover 144 is secured.

It will be seen that embodiments of the U-section frame profile in accordance with the present invention provide an adaptable system wherein a full range of door and window products can be readily manufactured to meet a wide range of consumer requirements in an economical fashion. The products thus produced are particularly useful in affording reduced labour requirements both in the manufacture of the above described frame, and in their installation, including the application of glazing units thereto and the fitting of the doors, windows etc. into adjacent related structures.

The foregoing embodiments have been described by way of illustration and are not intended to limit the invention thereto, the scope of which is defined in the following claims.

What is claimed is:

1. A frame for a substantially planar closure, said frame comprising a plurality of side members, each said member being of generally U-shaped channel section having a pair of opposed leg portions with an interconnecting end portion therebetween, and forming an open sided substantially rectangular cavity to receive a substantially rectangular support member in inserted relation therein, the inner surface of said end portion having at least one protrusion extending inwardly therefrom within said cavity, to space said support member in load transfer substantially thermal isolating relation from said section end portion; the outer surface of said end portion providing an inner peripheral surface to the frame member having a glazing stop abutment extending there along in spaced relation from said frame member, and a glazing stop recess extending parallel therewith in spaced relation from said abutment, having said opposed leg portions extending outwardly of the frame as peripheral face portions thereof, said channel section providing access to the frame interior for interior frame portions located therein.

2. The frame member as set forth in claim 1, in combination with a plurality of similar U-section members in secured relation therewith to provide an at least partial peripheral frame.

3. The combination as set forth in claim 2, including interior frame portions inserted within said section.

4. The frame as set forth in claim 3, a said interior portion comprising an insulating member.

5. The frame as set forth in claim 3, said interior portion comprising an inner frame.

6. The frame as set forth in claim 5, said inner frame having corner portions thereof in mutually joined relation.

7. The frame as set forth in claim 5, said inner frame being of metal.

8. The frame as set forth in claim 5, said inner frame being of wood.

9. The frame as set forth in claim 5, said inner frame being of insulating material.

10. The frame as set forth in claim 3, including fitting members secured within said section and extending outwardly therefrom to project beyond the periphery of the frame, to facilitate fitting of the frame to a frame opening.

11. The frame as set forth in claim 2, said U-shaped section including a glazing stop ledge portion located between said leg portions and extending inwardly of the frame to receive a closure unit in peripherally supported relation.

12. The frame as set forth in claim 11, said closure unit being a glazing unit.

13. The frame as set forth in claim 12, in combination with said glazing unit, and including a second glazing stop ledge portion to secure said glazing unit to said frame.

14. The combination as set forth in claim 13, said second glazing stop ledge portion being secured in snap-in attached relation with said frame.

15. The combination as set forth in claim 14, including an elastomeric gasket in sealing relation with said glazing unit.

16. The frame as set forth in claim 2, having corner portions thereof in mutually secured relation, and at least a portion of metal structural frame located substantially therein, having corner portions of said structural frame in mutually secured relation.

17. The structure as set forth in claim 16, including peripheral cover plates in assembled relation between the outer edges of said leg portions of said U-shaped section, for at least a portion of the periphery of the frame.

18. The structure as set forth in claim 13, said glazing unit comprising a pair of glass panels in mutually spaced, edge-sealed relation, containing an insulative gas therebetween.

19. The structure as set forth in claim 5, comprising an outer door frame, to contain a door in displaceable relation therein.

20. The structure as set forth in claim 5, comprising a closure sash frame, for use within an outer frame.

21. The structure as set forth in claim 5, including location hardware secured in load transfer relation within said U-section for interaction with associated load transfer means located substantially externally from said U-section.

22. The combination as set forth in claim 3, a said interior frame portion comprising web reinforcement means extending laterally between said opposed leg portions, in bracing relation therebetween.

23. The combination as set forth in claim 22, including cover means removably connecting said leg portions at the end thereof remote from said interconecting end portion.

24. The combination as set forth in claim 3, said U-shaped section having laterally extending rib means therein to secure said interior frame portions in positioned relation within said section.

25. The combination as set forth in claim 14, said snap-in glazing stop having catch means engageable with said U-section ledge portion, to secure said glazing stop in assembled relation with a glazing assembly.

26. The combination as set forth in claim 25, said snap-in glazing stop including elastomeric seal means interposed in sealing relation against said glazing assembly, being laterally elastically compressible thereagainst, to facilitate assembly of said glazing stop to said U-shaped section.

27. In a system for fabricating a frame, a method comprising the steps of: providing a plurality of generally U-section members of predetermined length; joining said members in corner abutting relation to form a frame of predetermined shape and size, an end portion of the U-section forming an inner periphery of the frame, and side members of the U-section forming face portions of the frame and affording free access to the open interior of the frame section, said open interior providing a peripheral cavity extending about the frame having an inner end face with at least one spacing means protruding inwardly within the cavity, and locating portions of a peripheral support frame within the cavity in substantially thermally isolated, load transfer relation with said U-section end portion.

28. The method as set forth in claim 27 including locating additional components in secured relation within the Usection interior.

29. The method as set forth in claim 28 including locating internal frame reinforcement members within said frame section.

30. The method as set forth in claim 29 including joining said frame reinforcement members in mutual end-joined relation.

31. The method as set forth in claim 29 including locating and securing hardware for said frame at least partially within said section interior.

32. The method as set forth in claim 27 including securing dressing strips about the periphery of said frame.

33. The method as set forth in claim 32, including dressing said dressing strips in-situ to fit said frame to a predetermined aperture.

34. The method as set forth in claim 27 including foaming the interior of said frame with a substantially permanent foam.

35. The method as set forth in claim 27 including securing section closure plates in closing relation with at least selected portions of said frame periphery.

36. The method as set forth in claim 27, including forming said generally U-section members incorporating said at least one spacing means to provide a rib-like member extending about at least a major portion o the inner periphery of said frame.

37. The method as set forth in claim 27 including securing a glazing unit within the inner periphery of said frame.

* * * * *